US007104637B1

(12) United States Patent
Van Steenkiste

(10) Patent No.: US 7,104,637 B1
(45) Date of Patent: Sep. 12, 2006

(54) INK SUPPLY SYSTEM AND METHOD OF SUPPLYING INK

(75) Inventor: David G. Van Steenkiste, Phoenix, AZ (US)

(73) Assignee: Imaje AB, Gothenburg (SE)

( * ) Notice: Subject to any disclaimer, the term of this patent is extended or adjusted under 35 U.S.C. 154(b) by 205 days.

(21) Appl. No.: 10/782,146

(22) Filed: Feb. 18, 2004

Related U.S. Application Data

(60) Provisional application No. 60/448,574, filed on Feb. 18, 2003.

(51) Int. Cl.
*B41J 2/175* (2006.01)

(52) U.S. Cl. ..... 347/85

(58) Field of Classification Search ..... 347/5, 347/7, 85; 141/2, 18
See application file for complete search history.

(56) References Cited

U.S. PATENT DOCUMENTS

| | | | | |
|---|---|---|---|---|
| 3,745,243 | A | 7/1973 | Seitz | |
| 4,067,020 | A * | 1/1978 | Arway | 347/7 |
| 4,340,896 | A | 7/1982 | Cruz-Uribe et al. | |
| 4,677,448 | A * | 6/1987 | Mizusawa et al. | 347/85 |
| 4,734,711 | A | 3/1988 | Piatt et al. | |
| 4,764,780 | A | 8/1988 | Yamamori et al. | |
| 5,489,925 | A | 2/1996 | Brooks et al. | |
| 5,491,540 | A | 2/1996 | Hirst | |
| 5,699,091 | A | 12/1997 | Bullock et al. | |
| 5,929,882 | A | 7/1999 | Sharpe | |
| 5,992,986 | A | 11/1999 | Gyotoku et al. | |
| 6,139,136 | A | 10/2000 | Mackay et al. | |
| 6,196,668 | B1 | 3/2001 | Bode | |
| 6,281,916 | B1 | 8/2001 | Van Steenkiste | |
| 6,406,120 | B1 | 6/2002 | Pauschinger | |
| 6,467,888 | B1 | 10/2002 | Wheeler et al. | |
| 6,883,905 | B1 * | 4/2005 | Kimura et al. | 347/85 |
| 2002/0063760 | A1 | 5/2002 | Dietl et al. | |

* cited by examiner

*Primary Examiner*—Anh T. N. Vo
(74) *Attorney, Agent, or Firm*—Schmeiser, Olsen & Watts LLP

(57) ABSTRACT

A closed ink supply system wherein air is sealed outside the system and not allowed to flow into components of the system may include an ink source. A first ink sub-reservoir may also be included that comprises a first top fluid surface at a first sub-reservoir fluid height, a first sub-reservoir ink inlet fluidly connected to the ink source, and a first sub-reservoir outlet and a second sub-reservoir outlet that is above the first sub-reservoir outlet. A print head may also be included that comprises a first print head portion fluidly connected to the first sub-reservoir outlet, and a second print head portion fluidly connected to the second sub-reservoir outlet. The second print head portion may be above the first print head portion, whereby a first pressure at the first print head portion is substantially equal to a second pressure at the second print head portion.

19 Claims, 8 Drawing Sheets

INK SUPPLY SYSTEM AND METHOD OF SUPPLYING INK

CROSS REFERENCE TO RELATED APPLICATION

This application claims priority to U.S. Provisional Patent Application to David VanSteenkiste entitled "INK SUPPLY SYSTEM AND METHOD OF SUPPLYING INK," Ser. No. 60/448,574, filed Feb. 18, 2003, now pending, the disclosure of which is hereby incorporated entirely herein by reference.

BACKGROUND OF THE INVENTION

1. Technical Field

This invention generally relates to an ink supply system and method of supplying ink, and more specifically relates to a method and system for supplying ink to a print head at substantially constant static pressure.

2. Background Art

The present invention is particularly well suited for use with sophisticated ink jet printers, although it is not limited to use with such printers. With these sophisticated ink jet printers, it is desirable to produce extremely high quality images on wide webs of paper or other printable surfaces as the surfaces move at very fast printing rates relative to printing heads. The requirements of these sophisticated ink jet printers in terms of accuracy of paper feed, methods of paper feed, and print head to paper distance are much higher than in conventional ink jet printers and pose problems not encountered in conventional printers.

There are conventional ink supply systems for sophisticated ink jet printers. However, several problems arise from use of these conventional ink supply systems. For example, in some systems a single supply must be used for all sub-reservoirs. In other systems, air is introduced into the ink within the sub-reservoirs, especially during priming of the system. In still other systems, the supply system includes one print head for each sub-reservoir, which increases the complexity and cost of the system. In yet other systems, the supply system is prone to surges of ink within the system.

In commercial ink jet printing applications, sophisticated ink jet printers are typically needed having a large printing area to permit printing of a large image on a target surface without multiple passes of the surface past the printing head. Furthermore, printing often must be done on a surface that is in some orientation other than horizontal. This requires a single print head using staggered ink inlet heights or multiple, smaller print heads with each head at staggered heights. However, for such non-horizontal print head arrangements, problems exist associated with the control of static pressure, and their commercial advantages have heretofore been limited by increasing costs or complexity relating to ink storage and delivery.

It is not feasible to supply a single print head using staggered ink inlet heights or multiple, smaller print heads with each head at staggered heights from a common reservoir because substantially uniform static pressure cannot be achieved (i.e. ink inlets or print heads disposed above the common reservoir fluid level experience negative static pressure, while those disposed below the reservoir experience positive static pressure). While it is feasible to provide each ink inlet or print head with a separate, level-controlled reservoir, the cost of such an arrangement is prohibitive. Additionally, the space limitations and tight spacing between print heads make it physically impractical to install reservoirs and level-control devices in this configuration.

Accordingly, what is needed is an ink supply system which may be easily and inexpensively constructed and a method of supplying ink which provides substantially constant and dependable control of the static pressure of ink delivered to a single print head using staggered ink inlet heights or to multiple, smaller print heads with each head at staggered heights.

DISCLOSURE OF THE INVENTION

The present invention may be readily adapted to a variety of ink supply systems and methods of supplying ink that overcome the problems associated with conventional ink supply systems for sophisticated ink jet printers. However, the present invention may be used for supplying ink in applications other than for sophisticated ink jet printers.

In particular embodiments, the present invention provides a closed ink supply system wherein air is sealed outside the system and not allowed to flow into components of the system. The ink supply system may include an ink source. A first ink sub-reservoir may also be included that comprises a first top fluid surface at a first sub-reservoir fluid height, a first sub-reservoir ink inlet fluidly connected to the ink source, and a first sub-reservoir outlet and a second sub-reservoir outlet that is above the first sub-reservoir outlet. A print head may also be included that comprises a first print head portion fluidly connected to the first sub-reservoir outlet, and a second print head portion fluidly connected to the second sub-reservoir outlet. The second print head portion may be above the first print head portion, whereby a first pressure at the first print head portion is substantially equal to a second pressure at the second print head portion.

A valve system may be fluidly connected between the ink source and the first sub-reservoir ink inlet and may include a first valve connected to the first actuator. An actuator system may be connected to the valve system and may include a first actuator connected to the first sensor. A first sensor may be connected to the actuator system. The first sensor may sense the first sub-reservoir fluid height. If the first sub-reservoir fluid height is below a first height range, the first sensor emits a signal to the actuator system, whereby the actuator system actuates the valve system, allowing ink to flow from the ink source to the first sub-reservoir ink inlet. If the first sub-reservoir fluid height is above the first height range, the first sensor emits a signal to the actuator system, whereby the actuator system actuates the valve system, preventing ink from flowing from the ink source to the first sub-reservoir ink inlet. The ink source may include a main reservoir, and the fluid connection between the first sub-reservoir ink inlet and the ink source may include a gravity-fed conduit extending from the ink source to the first sub-reservoir ink inlet. The first sub-reservoir ink inlet may be located at an upper portion of the first sub-reservoir, while the first sub-reservoir outlet and the second sub-reservoir outlet may be located at a lower portion of the first sub-reservoir. The first ink sub-reservoir may be adjustable in height. The ink supply system may further include a pressure source. If so, the first ink sub-reservoir may further include a first sub-reservoir pressure inlet fluidly connected to the pressure source.

The ink supply system may further include a second ink sub-reservoir that comprises a second top fluid surface at a second sub-reservoir fluid height that is above the first sub-reservoir fluid height, a second sub-reservoir ink inlet fluidly connected to the ink source, and a third sub-reservoir outlet and a fourth sub-reservoir outlet that is above the third sub-reservoir outlet. If so, the print head may further include a third print head portion fluidly connected to the third sub-reservoir outlet, and a fourth print head portion fluidly connected to the fourth sub-reservoir outlet. The fourth print head portion may be above the third print head portion and the third print head portion may be above the second print head portion. A third pressure at the third print head portion and a fourth pressure at the fourth print head portion may be substantially equal to the first pressure at the first print head portion and the second pressure at the second print head portion.

A valve system may be fluidly connected between the ink source and the second sub-reservoir ink inlet and may include a second valve connected to a second actuator. An actuator system may be connected to the valve system and may include a second actuator connected to the second sensor. A second sensor may be connected to the actuator system. The second sensor may sense the second sub-reservoir fluid height. If the second sub-reservoir fluid height is below a second height range, the second sensor emits a signal to the actuator system, whereby the actuator system actuates the valve system, allowing ink to flow from the ink source to the second sub-reservoir ink inlet. If the second sub-reservoir fluid height is above the second height range, the second sensor emits a signal to the actuator system, whereby the actuator system actuates the valve system, preventing ink from flowing from the ink source to the second sub-reservoir ink inlet. The fluid connection between the second sub-reservoir ink inlet and the ink source may include gravity-fed conduits extending from the ink source to the second sub-reservoir ink inlet. The second sub-reservoir ink inlet may be located at an upper portion of the second sub-reservoir, while the third sub-reservoir outlet and the fourth sub-reservoir outlet may be located at a lower portion of the second sub-reservoir. The second ink sub-reservoir may be adjustable in height. If a pressure source is included, the second ink sub-reservoir may further include a second sub-reservoir pressure inlet fluidly connected to the pressure source.

In particular embodiments, the present invention provides a closed ink supply system wherein air is sealed outside the system and not allowed to flow into components of the system. The ink supply system may include a main reservoir and a pressure source. A first ink sub-reservoir may also be included that comprises a first top fluid surface at a first sub-reservoir fluid height, a first sub-reservoir ink inlet fluidly connected to the main reservoir, a first sub-reservoir pressure inlet fluidly connected to the pressure source, and a first sub-reservoir outlet and a second sub-reservoir outlet that is above the first sub-reservoir outlet. A second ink sub-reservoir may also be included that comprises a second top fluid surface at a second sub-reservoir fluid height that is above the first sub-reservoir fluid height, a second sub-reservoir ink inlet fluidly connected to the main reservoir, a second sub-reservoir pressure inlet fluidly connected to the pressure source, and a third sub-reservoir outlet and a fourth sub-reservoir outlet that is above the third sub-reservoir outlet. A valve system may be fluidly connected between the main reservoir and the first sub-reservoir ink inlet and the second sub-reservoir ink inlet. An actuator system may be connected to the valve system. A first sensor may be connected to the actuator system. The first sensor may sense the first sub-reservoir fluid height. If the first sub-reservoir fluid height is below a first height range, the first sensor emits a signal to the actuator system, whereby the actuator system actuates the valve system, allowing ink to flow from the main reservoir to the first sub-reservoir ink inlet. If the first sub-reservoir fluid height is above the first height range, the first sensor emits a signal to the actuator system, whereby the actuator system actuates the valve system, preventing ink from flowing from the main reservoir to the first sub-reservoir ink inlet. A second sensor may also be connected to the actuator system. The second sensor may sense the second sub-reservoir fluid height. If the second sub-reservoir fluid height is below a second height range, the second sensor emits a signal to the actuator system, whereby the actuator system actuates the valve system, allowing ink to flow from the main reservoir to the second sub-reservoir ink inlet. If the second sub-reservoir fluid height is above the second height range, the second sensor emits a signal to the actuator system, whereby the actuator system actuates the valve system, preventing ink from flowing from the main reservoir to the second sub-reservoir ink inlet. A print head may also be included that comprises a first print head portion fluidly connected to the first sub-reservoir outlet, a second print head portion fluidly connected to the second sub-reservoir outlet, a third print head portion fluidly connected to the third sub-reservoir outlet, and a fourth print head portion fluidly connected to the fourth sub-reservoir outlet. The fourth print head portion may be above the third print head portion, the third print head portion may be above the second print head portion, and the second print head portion may be above the first print head portion, whereby a first pressure at the first print head portion, a second pressure at the second print head portion, a third pressure at the third print head portion, and a fourth pressure at the fourth print head portion are substantially equal to one another.

In particular embodiments, the present invention provides a method of supplying ink to a print head through a closed ink supply system wherein air is sealed outside the system and not allowed to flow into components of the system. The method may include: supplying ink from a first ink sub-reservoir to a first print head portion fluidly connected to a first sub-reservoir outlet of the first ink sub-reservoir; supplying ink from the first ink sub-reservoir to a second print head portion above the first print head portion fluidly connected to a second sub-reservoir outlet above the first sub-reservoir outlet of the first ink sub-reservoir, whereby a first pressure at the first print head portion is substantially equal to a second pressure at the second print head portion; sensing a first sub-reservoir fluid height; supplying ink to the first ink sub-reservoir if the first sub-reservoir fluid height is below a first height range; and ceasing supplying ink to the first ink sub-reservoir if the first sub-reservoir fluid height is above the first height range. Supplying ink to the first ink sub-reservoir may include using gravity to feed ink through a conduit that extends from an ink source to the first ink sub-reservoir. Alternatively, supplying ink to the first ink sub-reservoir may include actuating a valve system, and ceasing supplying ink to the first ink sub-reservoir may include actuating the valve system. The method may further include adjusting a height of the first ink sub-reservoir.

The method may further include: supplying ink from a second ink sub-reservoir to a third print head portion above the second print head portion fluidly connected to a third sub-reservoir outlet of the second ink sub-reservoir; supplying ink from the second ink sub-reservoir to a fourth print head portion above the third print head portion fluidly connected to a fourth sub-reservoir outlet above the third sub-reservoir outlet of the second ink sub-reservoir, whereby a third pressure at the third print head portion is substantially equal to a fourth pressure at the fourth print head portion; sensing a second sub-reservoir fluid height above the first sub-reservoir fluid height; supplying ink to the second ink sub-reservoir if the second sub-reservoir fluid height is below a second height range; and ceasing supplying ink to the second ink sub-reservoir if the second sub-reservoir fluid height is above the second height range.

The foregoing and other features, steps, and advantages of the invention will be apparent to those of ordinary skill in the art from the following more particular description of the invention and the accompanying drawings.

BRIEF DESCRIPTION OF THE DRAWINGS

The invention will hereinafter be described in conjunction with the appended drawings, where like designations denote like elements.

DESCRIPTION OT THE INVENTION

Figure 1:
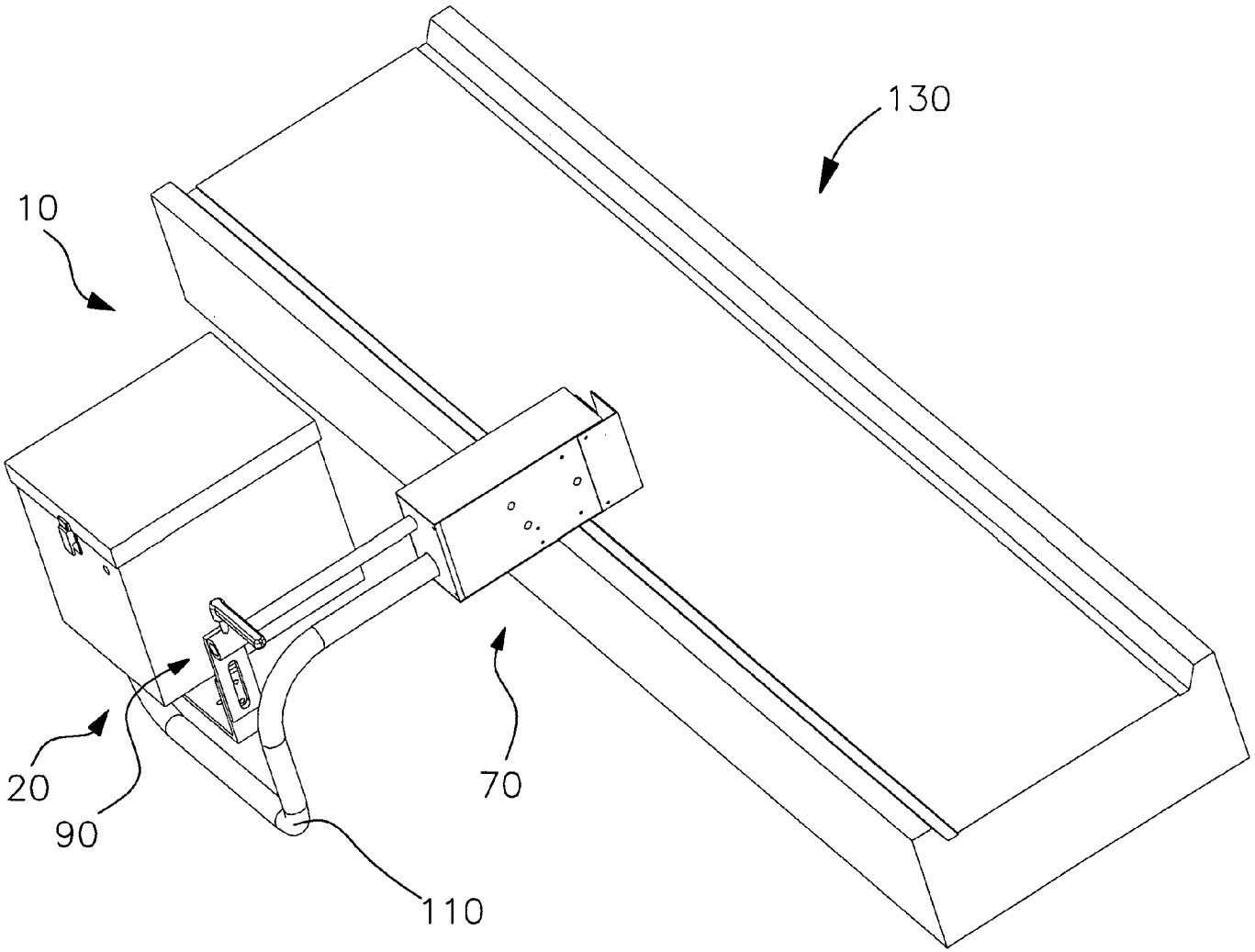
FIG. 1 is a perspective view of an ink supply system configured according to an embodiment of the present invention in conjunction with a conveyor belt assembly.

In general, ink delivery systems of the invention are for an ink jet printer that prints on a surface that is in some orientation other than horizontal. Ink delivery systems of the invention are configured to deliver ink for printing to either a single print head (such as a Piezo print head) using staggered ink inlet heights or to multiple, smaller print heads with each head at staggered heights. In a situation where the printing surface is in some orientation other than horizontal, the difference in height across the print head creates a pressure difference across the print head (i.e., the ink pressure is greater at the lower portion of the print head).

In ink jet printers, a print head typically has numerous small nozzles or orifices for spraying very fine ink sprays at specific times, and ink typically is provided to the print head from a reservoir. In terms of static pressure, it is important that substantially uniform static pressure, typically a small negative static pressure, is achieved at each ink jet orifice on a print head to avoid orifice drool. Static pressure within the print head is largely a function of the static fluid pressure at the print head inlet, since capillary forces within a given print head offset any appreciable variation in pressure head among the orifices in that print head. Thus, the static pressure at the print head inlet influences the pressure at the ink jet orifices which are in immediate proximity to the inlet. The optimal static pressure is determined by the physical properties of the ink, such as viscosity and surface tension, wetability and the substrate material used to construct the orifices. Ordinarily, the optimal static pressure of the ink is negative one to three inches of water. The static pressure at the print head inlet may be a function of the difference in height between the inlet and the reservoir ink level.

Generally, ink delivery systems of the invention may include an ink source, such as a main reservoir, that supplies at least one sub-reservoir, such as two sub-reservoirs. The sub-reservoirs may be at staggered heights or may be adjustable to varying heights, thereby allowing the capability to configure the single print head or the multiple, smaller print heads to print in a 0° to 90° range (the primary range of operation being from horizontal to vertical). Each sub-reservoir may include at least two ink outlets at staggered heights. Each sub-reservoir outlet may supply a different portion of the single print head or one of the smaller print heads. The staggered heights of the outlets of each of the sub-reservoirs varies depending on what portion of the single print head or smaller print heads the outlets will supply (i.e., the height of an outlet supplying a lower portion of the single print head or a lower smaller print head is less than the height of an outlet supplying an upper portion of the single print head or an upper smaller print head). The difference in heights of the outlets is proportional to the difference in heights of the portions of the single print head or smaller print heads that they are supplying so that the ink pressure is substantially constant.

Accordingly, although the invention may be readily adapted to a variety of embodiments of an ink supply system, with reference to FIGS. 1–4, ink supply system 10 is an example of an ink supply system of the invention. Ink supply system 10 generally includes housing assembly 20, chassis assembly 40, print head assembly 70, print head bracket assembly 90, ink supply system assembly bracket 100, conduit assembly 110, and L.E.D. assembly 120.

Figure 2:
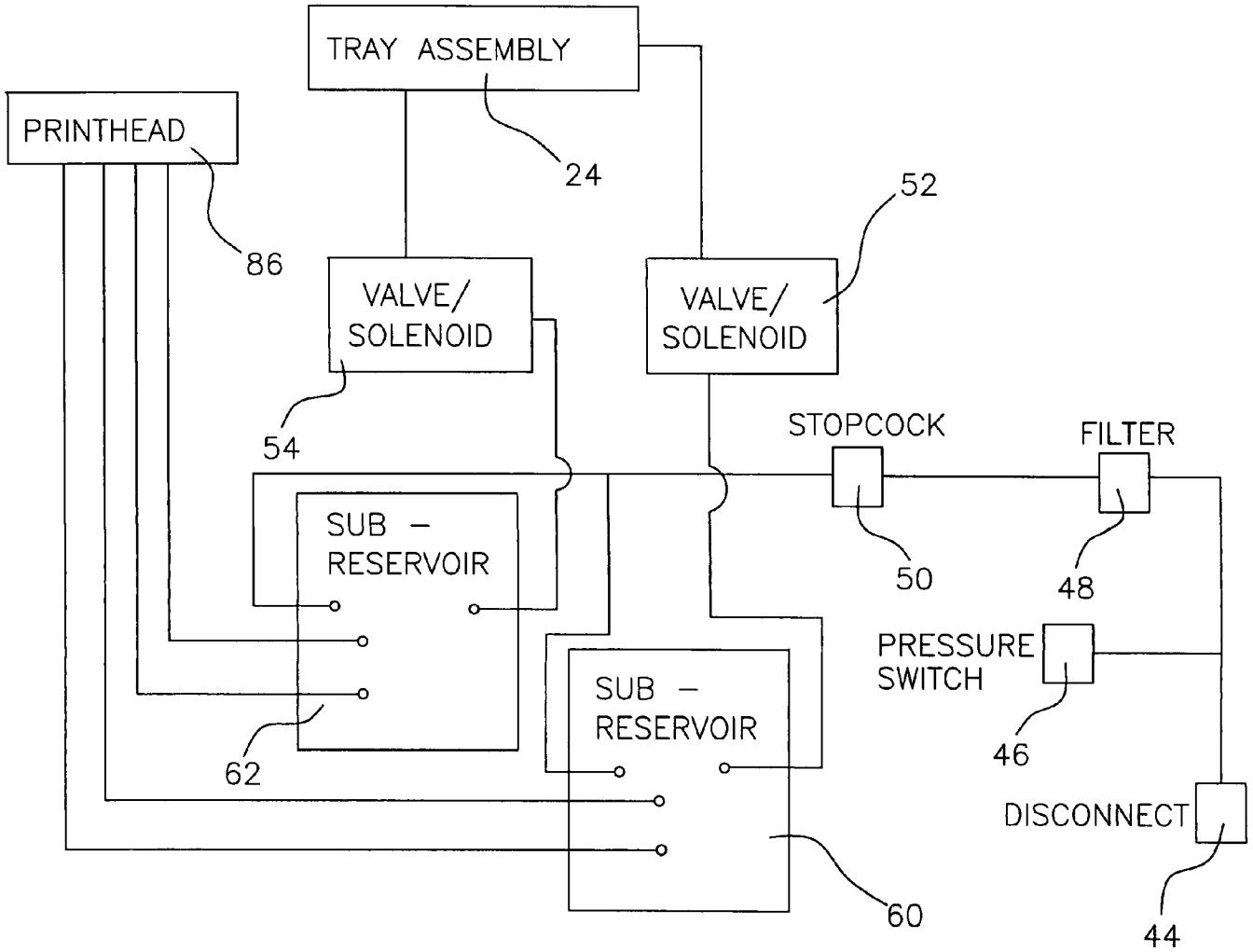
FIG. 2 is a diagram of the ink supply system of FIG. 1.

Referring now to FIGS. 1–2, ink supply system 10 generally includes a main reservoir located in ink tray assembly 24 that may fluidly feed ink through a pair of conduits, through valve/solenoid assemblies 52, 54, through another pair of conduits, through sub-reservoir ink inlets, to sub-reservoirs 60, 62 with the height of the fluid surface within each of the sub-reservoirs 60, 62 being staggered. While FIG. 2 shows two sub-reservoirs 60, 62, those of skill in the art will recognize that the present invention will produce advantages with systems having any number of sub-reservoirs. Sub-reservoirs 60, 62 each fluidly feed ink through a pair of staggered sub-reservoir outlets respectively, through a pair of conduits respectively, through four corresponding inlets of print head 86, to corresponding portions of print head 86, to a surface to be printed that may be moving past print head 86 on conveyor belt assembly 130. Thus, the main reservoir is fluidly connected to each of sub-reservoirs 60, 62 and each of the sub-reservoirs 60, 62 is fluidly connected to corresponding portions of print head 86.

Portions of print head 86 may be above the corresponding sub-reservoir 60, 62 respectively. The heights of the inlets of print head 86, and hence the portions of print head 86, are staggered by substantially the same amount as the staggers of the pairs of sub-reservoir outlets of each corresponding sub-reservoir 60, 62. In a preferred embodiment, the height difference between adjacent sub-reservoirs 60, 62 is about 0.7 inch when print head 86 is printing on a vertical surface. If the height differences are not substantially the same, then the pressures at different portions of print head 86 will deviate substantially from each other. Such deviated pressures will disrupt operation of print head 86.

Thus, the staggers between the sub-reservoirs 60, 62 should be increased or decreased depending on the orientation of print head 86. For example, the staggers should be greater if the print head portions are vertically aligned than if the print head portions are aligned along a line at a 45 degree angle. Thus, the present invention can be adapted for use with print heads at any of several different orientations.

Referring still to FIG. 2, each sub-reservoir defines a pressure inlet to which is fluidly connected to a sub-pressure conduit. The sub-pressure conduit is fluidly connected to a main pressure conduit, which extends through stopcock 50, through filter 48, through pressure switch 46, through disconnect 44, to a pressure source.

The foregoing conduits may be any flexible tubing that can be easily attached to and detached from other components. The conduits may be made from a flexible material, such as high density polyethylene, and they may be clear so that a user can view the ink within the conduits to assure that ink is being properly supplied from the main reservoir. Particularly useful to the present invention may be any of the materials sold under the trademarks TYGON or BEV-A-LINE V. The conduits may have any inside diameter (I.D.) and outside diameter (O.D.), such as ⅛" I.D.×¼" O.D., 3/32" I.D.×5/32" O.D., and the like for example.

Figure 4:
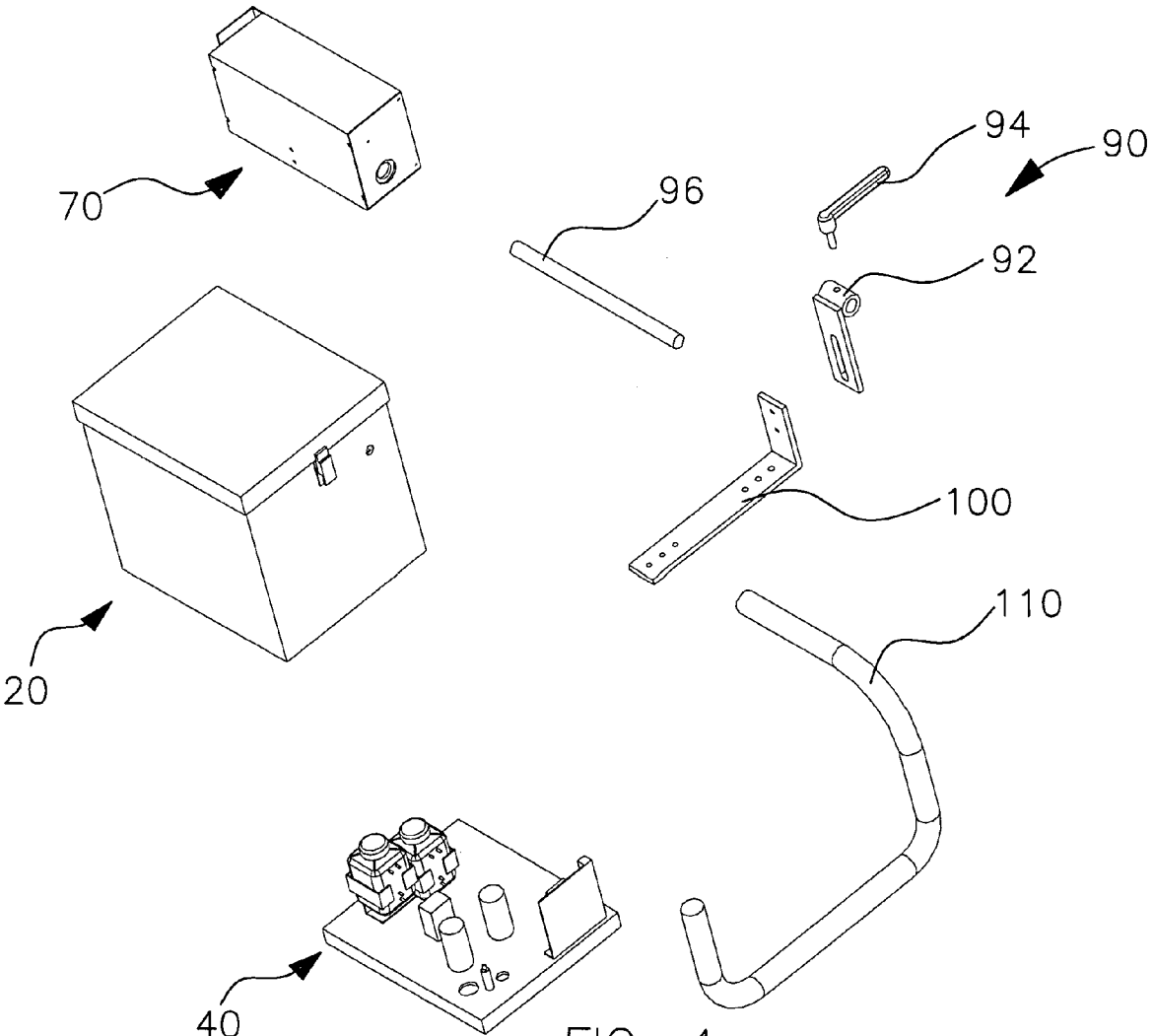
FIG. 4 is an exploded perspective view of the ink supply system of FIG. 1.
Figure 5:
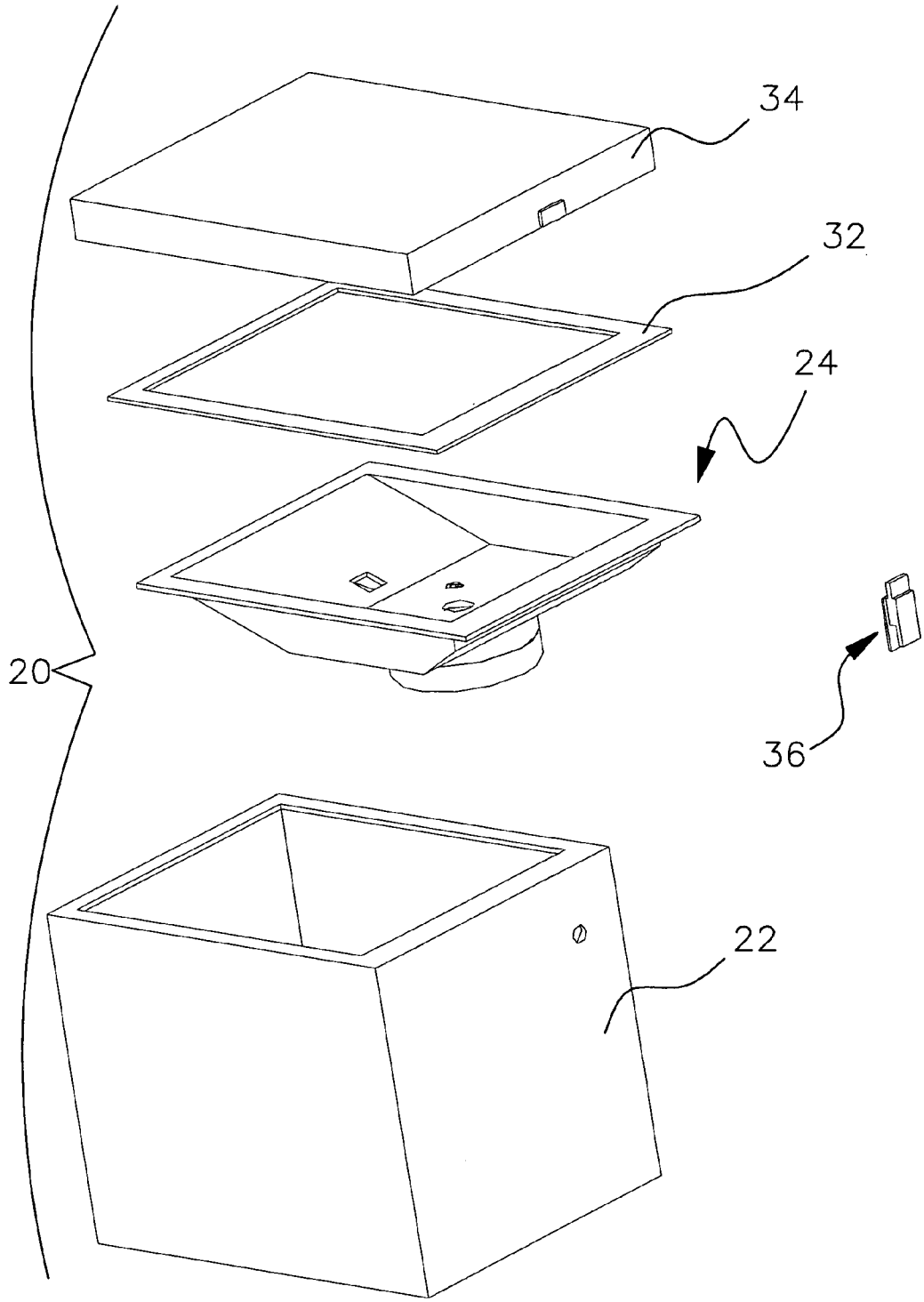
FIG. 5 is an exploded perspective view of a housing assembly of the ink supply system of FIG. 1.
Figure 6:
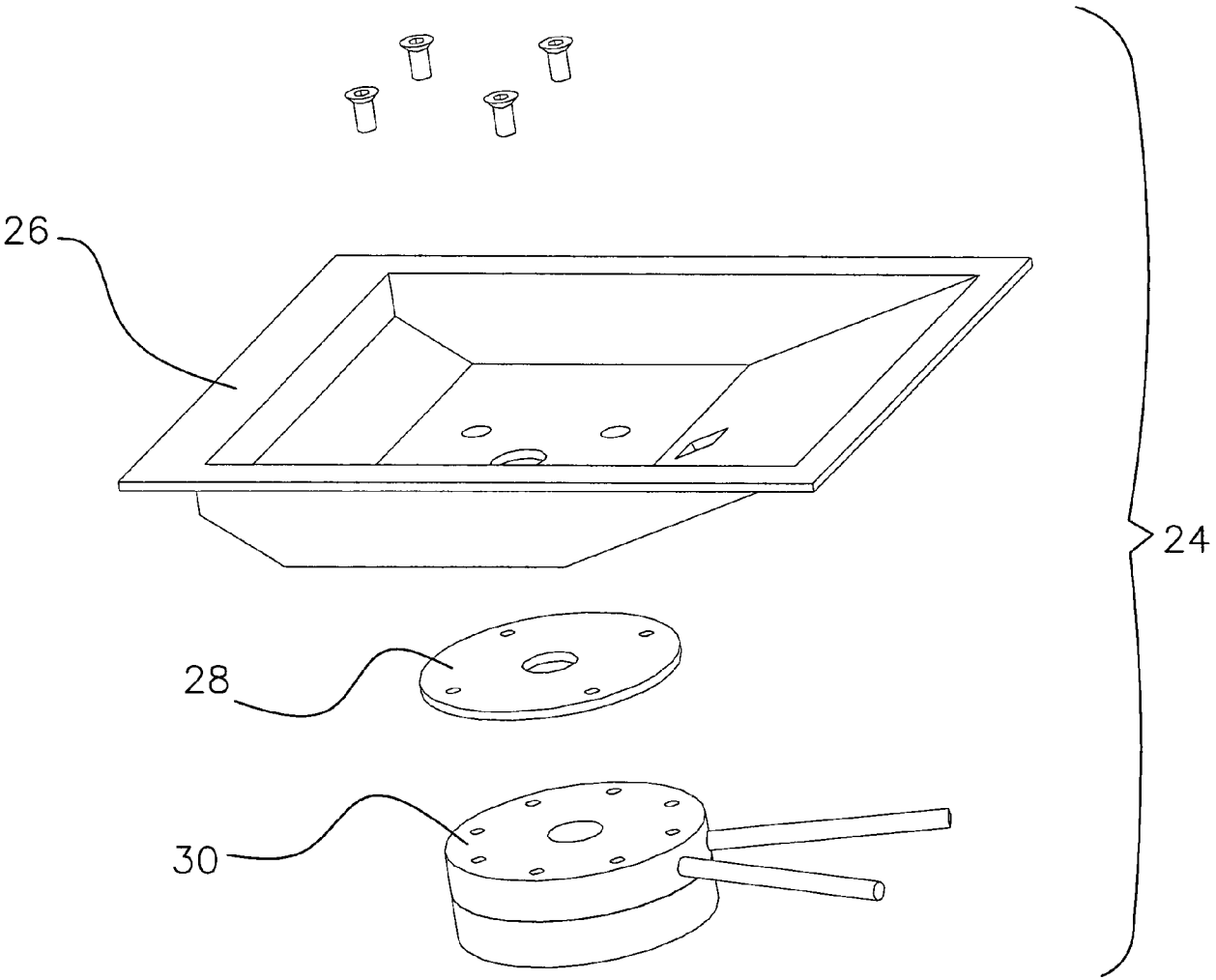
FIG. 6 is an exploded perspective view of an ink tray assembly of the ink supply system of FIG. 1.

Referring to FIGS. 4–6 and describing ink supply system 10 in greater detail, housing assembly 20 is configured to enclose many of the components of ink supply system 10 in a compact and secure rectilinear (e.g. square, rectangular, and the like) configuration. Housing assembly 20 may include main framework 22, ink tray assembly 24, seal 32, lid 34, and latch/catch assembly 36.

Main framework 22 may be a rectilinear box formed of sidewalls with no top or bottom walls. Ink delivery system 10 may be fed by any type of main reservoir acting as an ink source for ink supply system 10, such as a rigid pressure vessel, a disposable small bag/cartridge, a bulk feed, and the like for example pressurized by an air compressor, an electromechanical air pump, an in line pump, and the like for example. The bulk feed can feed up to four different ink delivery systems and multiple print heads. Ink supply system 10 also maintains a sealed philosophy—there is no venting of the main ink reservoir, causing air exposure requiring in line degassing, or causing solvent flash off or exposure to contaminants to the main ink reservoir.

Referring to FIGS. 5–6, main reservoir may include ink tray assembly 24 configured to provide a rigid support and, for the exemplary purposes of this disclosure, a main flexible container within ink tray assembly 24 that contains ink. Ink tray assembly 24 may include ink tray 26, ink filter gasket 28, ink filter 30. Ink tray 26 is configured to support the main flexible ink container and has a hole in a bottom thereof to allow an outlet on the main flexible ink container to be fluidly connected to ink filter 30. Ink filter gasket 28 is coupled between ink tray 26 and ink filter 30 to provide a seal and prevent ink leaks. Ink filter 30 may be any ink filter that catches any debris, contaminants, and the like that may be present in the ink supplied and includes two outlets that fluidly couple through conduit to corresponding ink inlets on each sub-reservoir 60, 62 respectively. The main flexible container or ink bag may be sealed to prevent contaminants from entering the ink contained therein. As ink is drained from the main flexible container, the main flexible container collapses until it is completely emptied. The main flexible ink container includes an outlet that is connected to ink filter 30.

Additionally, an ink ID chip may be embedded into the ink source's packaging (non-removable) for example. The ink ID chip would be required to be connected to controller 64. If it was not connected, the printer would not print. The ink ID chip is programmable to offer not only protection from third party ink providers, but also to provide value added to a customer. For example, when a new ink supply is connected, controller 64 will read the chip and display the ink expiration date, batch number, part number, and the like. Since many different ink types are sold in the same type of package, a customer could accidentally order or be mistakenly shipped the incorrect ink type. For example, if the customer had previously been running ink # 8000, then received ink #9000 by mistake, the ink delivery system will flash a warning stating that the incorrect ink has been installed sending a prompt to abort or continue. The customer would choose to continue if they had meant to change the ink and had gone through a proper changeover procedure. The ink ID chip would also be able to record droplet count and display a very accurate account of how much ink is left in the ink source.

Figure 7:
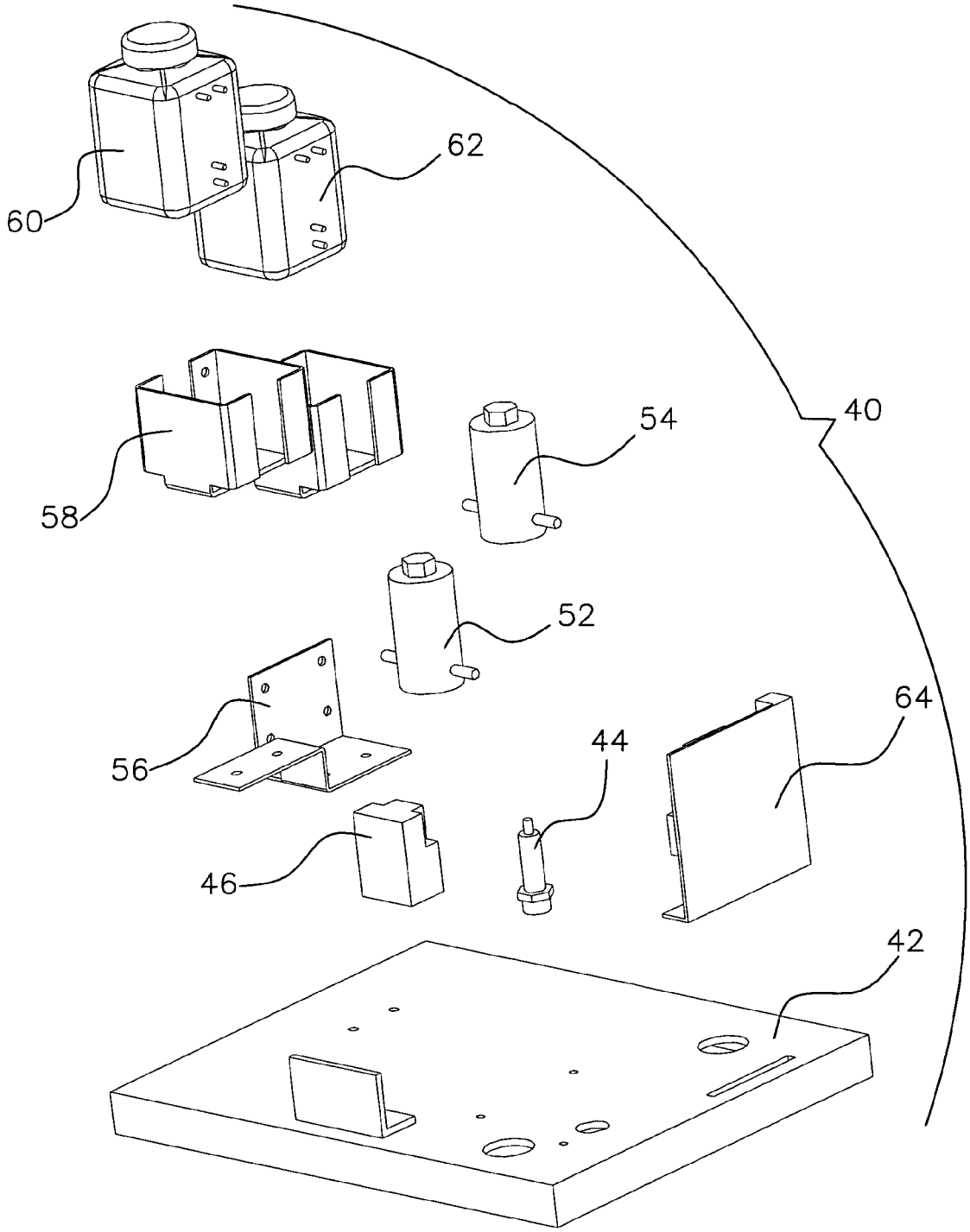
FIG. 7 is an exploded perspective view of a chassis assembly of the ink supply system of FIG. 1.

Referring to FIGS. 4 and 7 and describing ink supply system 10 in greater detail, chassis assembly 40 is configured to support many of the components of ink supply system 10. Chassis assembly 40 may include chassis pan 42, quick disconnect 44, pressure switch 46, filter 48, one way stopcock 50, valve/solenoid assemblies 52, 54, sub-reservoir holder base 56, sub-reservoir holder 58, sub-reservoirs 60, 62, controller 64, and level sensors.

Chassis pan 42 may be rectilinear in shape and forms a base to which main framework 22 may be coupled. Pressure switch 46 may include a pressure transducer connected to a power switch. The model MPL-601-G-14.8 PSI pressure switch available from Micro Pneumatic Logic in Fort Lauderdale, Fla. is particularly well-suited to the present invention, though any of several pressure switches will work with the present invention. Filter 48 may be any air filter that catches any debris, contaminants, and the like that may be present in the air supplied during priming. For the exemplary purposes of this disclosure, filter 48 may be a 10 micron air filter.

Valve/solenoid assemblies 52, 54 comprise valves of a valve system that are actuated by an actuator such as solenoids of an actuator system. Each valve/solenoid assembly 52, 54 may be the valve number A2013-S230 available from Precision Dynamics, Inc. in New Britain, Conn. for example. However, each valve 110, 112, 114, 116 may be some other type of valve and may be actuated by some other type of actuator.

Sub-reservoir holder base 56 may comprise a base having a portion adjustably coupled to main framework 22 and a tiered or staggered sub-reservoir holder portion Sub-reservoir holder 58 may comprise a pair of sleeve holders, each receiving a lower portion of sub-reservoirs 60, 62 respectively. Each sleeve holder may have a notch in a front face thereof to accommodate the pair of sub-reservoir ink outlets. Any moving mechanism may be provided to adjust the heights of sub-reservoir holder base 56 and/or sub-reservoir holder 58, and hence the heights of sub-reservoirs 60, 62 and the heights of the ink levels therein, relative to the heights of portions of print head 86. If sub-reservoir holder base 56, sub-reservoir holder 58, and sub-reservoirs 60, 62 are joined together as a staggered unit, the moving mechanism may be configured to adjust the height of the entire assembly.

Sub-reservoirs 60, 62 maintain a substantially constant fluid level of ink therein. Each sub-reservoir 60, 62 may be sealed and may comprise an air inlet an ink inlet located at an upper portion thereof, and a pair of staggered ink outlets located at a lower portion thereof. For the exemplary purposes of this disclosure, each sub-reservoir 60, 62 may comprise a container or bottle that includes a corresponding lid that encloses and seals the container. The containers or bottles are preferably made of a rigid material, such as the material sold under the trademark DELRIN.

Controller 64, such as any number of control boards known to those skilled in the art, works in conjunction with a central processing unit, such as a PC or an expandable PLC, which comprises a program with parameter settings.

Figure 3:
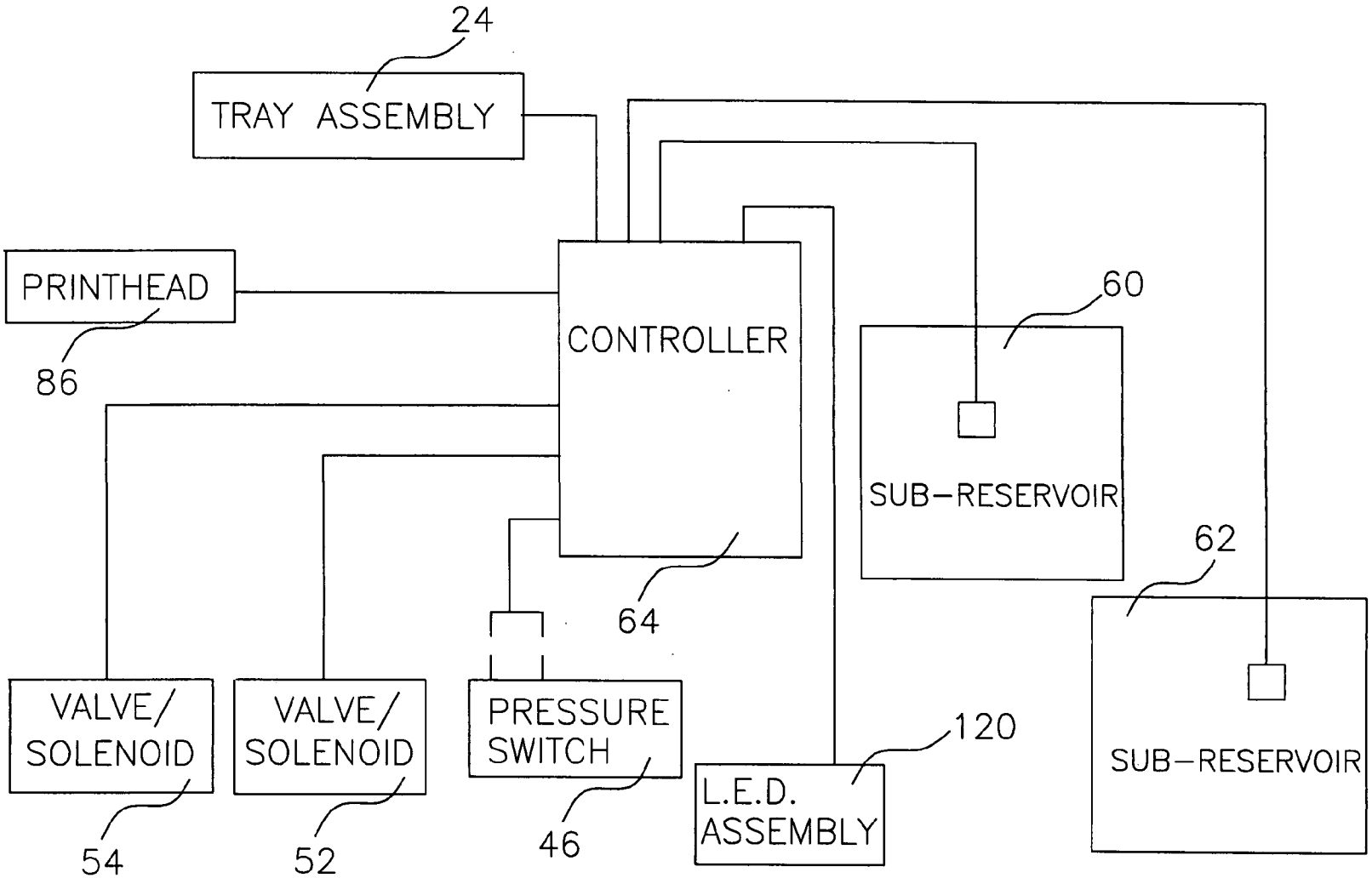
FIG. 3 is a circuit diagram of the ink supply system of FIG. 1.

As depicted in FIG. 3, together, they may coordinate and control all the electrical components and functions of ink supply system 10. The central processing unit also has associated therewith a local data storage device such as a local hard drive, random access memory (RAM), or other magnetic or electronic data storage medium. The local data storage device may be used for any number of data storage functions common to a processor, but is particularly useful for storing data necessary for the operation of ink supply system 10, such as an operating system and application software.

Still referring to FIG. 3, controller 64 provides and receives signals through communication lines that connect it to tray assembly, pressure switch 46, valve/solenoid assemblies 52, 54, sub-reservoirs 60, 62, print head 86, and L.E.D. assembly 120. Accordingly, controller 64 receives printing signals via a controller communication line. Controller 64 sends printing signals to print head 86 via a print head communication line. Controller 64 sends signals to valve/solenoid assemblies 52, 54 if the fluid level height in sub-reservoirs 60, 62 is above or below a given range as signaled to controller 64 by level sensors as described below. Controller 64 receives signals from a level sensor associated with tray assembly 24 when ink is low and controller 64 sends signals to L.E.D. assembly 120 to indicate such a condition. Controller 64 receives signals from pressure switch 46 when it senses increased pressure and controller 64 sends return signals to pressure switch 46 prompting it to open to prevent power from reaching valve/solenoid assemblies 52, 54.

Level sensors may be any sensor that senses the height of the fluid level of ink within each sub-reservoir 60, 62, respectively. Level sensors may be induction sensors, such as the induction sensors sold under the trademark CUTLER-HAMMER available from Eaton Corporation in Cleveland, Ohio.

Figure 8:
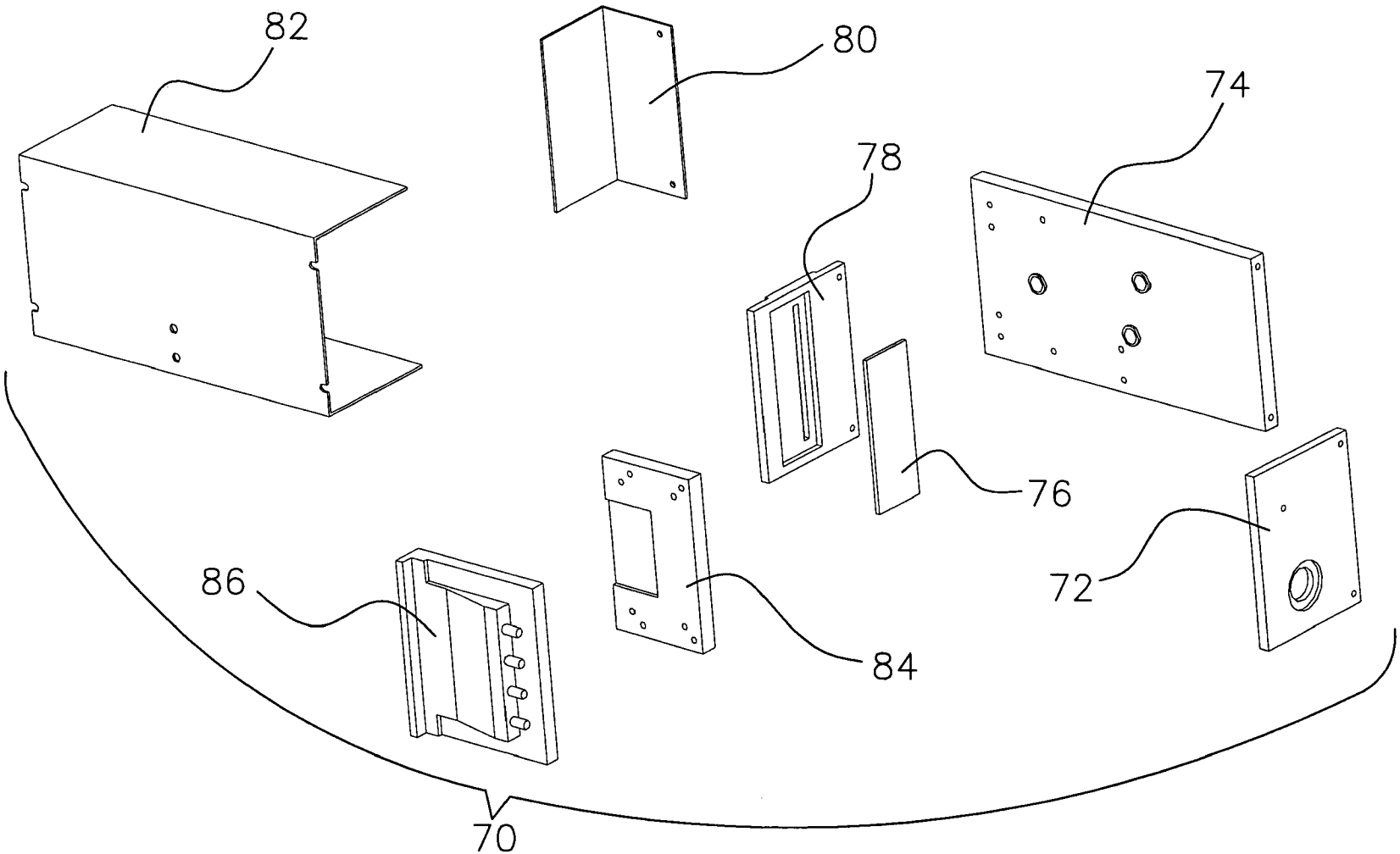
FIG. 8 is an exploded perspective view of a print head assembly of the ink supply system of FIG. 1.

Referring to FIGS. 4 and 8 and describing ink supply system 10 in greater detail, print head assembly 90 may include print head enclosure back 72, print head enclosure base 74, shipping seal 76, print head enclosure face 78, print head cover 80, print head enclosure cover 82, print head enclosure mounting bracket 84, and print head 86. For the exemplary purposes of this disclosure, print head 86 may be a type of print head that has multiple inlets, which each feed a separate print head portion. For example, the 500 print head with multiple inlets available from XaarJet in Cambridge, England works particularly well. However, multiple print heads, such as multiple 128 print heads, could be used rather than using a single print head with multiple inlets feeding multiple portions. Furthermore, a composite printing head including a plurality of ink jet print heads may be used. In addition, in some applications it might be preferable to use aspects of the present invention with a single print head having a single inlet. Those skilled in the art will recognize and be able to implement the adaptations necessary for using such print heads with the present invention. Print head 86 may be stationary and arranged to print an image on a target surface (not shown) which moves relative thereto. Alternatively, printing head 86 can be movable relative to the target surface, or both printing head 86 and the target surface can be movable relative to each other.

Referring to FIGS. 1–4 and describing ink supply system 10 in greater detail, print head bracket assembly 90 is configured to adjustably support print head assembly 70. Print head bracket assembly 90 may include bracket 92, adjustable lever 94, and shaft 96. Bracket 92 may comprise a shaft-receiving sleeve coupled to one end of a slotted vertical adjusting plate. Adjustable lever 94 is mounted through a top or side of shaft-receiving sleeve to removably secure shaft 96 therein in a substantially horizontal slidable arrangement. Notwithstanding, any other adjustment mechanism may be provided to adjust the heights of portions of print head 86 relative to the level of the ink in each sub-reservoir 60, 62.

Referring to FIG. 4 and describing ink supply system 10 in greater detail, ink supply system assembly bracket 100 is configured to couple housing assembly 20 and chassis assembly 40 to print head bracket assembly 90 and print head assembly 70. Ink supply system assembly bracket 100 may include an L-shaped bracket. The slotted vertical adjusting plate of print head bracket assembly 90 may be removable attached to the L-shaped bracket by use of at least one fastener removably coupled through the slot of the vertical adjusting plate to the L-shaped bracket.

Referring to FIGS. 1 and 4 and describing ink supply system 10 in greater detail, conduit assembly 110 is configured to safe environment to consolidate conduit coming from sub-reservoir ink outlets to portions of print head 86. Referring to FIGS. 3–5 and describing ink supply system 10 in greater detail, L.E.D. assembly 120 is configured to indicate a low ink level condition in the main ink reservoir. L.E.D. assembly 120 may be coupled through a front side of main framework 22.

It will be understood by those of ordinary skill in the art that the invention is not limited to the specific ink supply systems and components disclosed herein, as virtually any components known in the art consistent with the intended operation of an ink supply system of the invention may be utilized. Accordingly, for example, although particular housing assemblies, main frameworks, ink tray assemblies, ink trays, ink filter gaskets, ink filters, seals, lids, latch/catch assemblies, chassis assemblies, chassis pans, quick disconnects, pressure switches, filters, one way stopcocks, valve/solenoid assemblies, sub-reservoir holder bases, sub-reservoir holders, sub-reservoirs, controllers, level sensors, print head assemblies, print head enclosure backs, print head enclosure bases, shipping seals, print head enclosure faces, print head covers, print head enclosure covers, print head enclosure mounting brackets, print heads, print head bracket assemblies, brackets, adjustable levers, shafts, ink supply system assembly bracket, conduit assemblies, L.E.D. assemblies, and other components are disclosed, such components may comprise any shape, size, style, type, model, version, measurement, concentration, material, quantity, and/or the like as is known in the art for such components consistent with the intended operation of an ink supply system of the invention. It will also be understood by those of ordinary skill in the art that the invention is not limited to use of any specific components, provided that the components selected are consistent with the intended operation of an ink supply system of the invention.

The components defining any ink supply system embodiment of the invention may be formed of any of many different types of materials or combinations thereof that can readily be formed into shaped objects provided that the components selected are consistent with the intended operation of an ink supply system of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polyethylene, polystyrene, polypropylene, acyclic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The components defining any ink supply system embodiment of the invention may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, milling, stamping, cutting, welding, soldering, riveting, punching, and/or the like. If any of the components are manufactured separately, they may then be coupled with one another in any manner known in the art, such as with adhesive (e.g. silicone), a weld, a fastener (e.g. a bolt, a screw, a nail, a rivet, a pin, and the like), wiring, conduit, any combination thereof, and/or the like for example, depending on, among other considerations, the particular material forming the components. Other possible steps might include sand blasting, polishing, powder coating, anodizing, and/or painting the components for example.

It will be understood by those of ordinary skill in the art that the invention is not limited to uses relating to supplying ink in applications for sophisticated ink jet printers and the like. Rather, any description relating to supplying ink in applications for sophisticated ink jet printers and the like is for the exemplary purposes of this disclosure, and those of ordinary skill in the art will also understand that the invention may also be used in a variety of applications with similar results. Similarly, the invention has been designed to be chemically inert so that many ink formulations may be used. Accordingly, it will also be understood by those of ordinary skill in the art that the invention is not limited to any specific ink formulation, as any oil-based formulation, solvent-based formulation, UV-Curable formulation, aqueous formulation, and the like may be jetted with the invention. For example, solvent-based inks are advantageous, especially during fast-paced printing processes, because they dry quickly when applied to a printed surface.

Referring now to FIGS. 1–3, in using the ink supply system 10, sub-reservoirs 60, 62 must first be filled. This may be done by fluidly connecting the main reservoir or ink source to sub-reservoirs 60, 62 through valve/solenoid assemblies 52, 54 such that the main reservoir is above sub-reservoirs 60, 62 and will feed sub-reservoirs 60, 62 by force of gravity on the ink for example.

Initially, level sensors will sense that sub-reservoir fluid heights are below a specified range. The level sensors will then send signals to controller 64, which will send signals to valve/solenoid assemblies 52, 54, which will open, thereby supplying ink to sub-reservoirs 60, 62. Once sub-reservoirs 60, 62 are filled above the specified range, the level sensors will sense that sub-reservoir fluid heights are above a specified range. The level sensors will then send signals to controller 64, which will send signals to valve/solenoid assemblies 52, 54, which will close, thereby ceasing the supplying of ink to sub-reservoirs 60, 62. During filling, each sub-reservoir 60, 62, and each corresponding sensor and valve/solenoid assembly 52, 54 acts independently of the other sub-reservoir, sensor, valve/solenoid assembly.

Once each sub-reservoir 60, 62 are filled, ink supply system 10 may be primed. Priming may be necessary to clear any air from the orifices within the print head that may have accumulated during shipment, storage, and the like. To prime the system, positive air pressure from between 5 PSI and 10 PSI for example is supplied from a pressure source to each sub-reservoir 60, 62. Air may be applied either by several pressure source including an electromechanical air pump, hand air pump such as a blood pressure bulb, or an air compressor that is removably coupled to quick disconnect 44. This increases the pressure of ink within each sub-reservoir 60, 62, which forces ink out of each pair of sub-reservoir outlets through conduits and through corresponding inlets of print head 86. This should be continued for a sufficient time so that air and other contaminants within ink supply system 10 are forced out of print head 86.

To allow the air to flow and to pressurize the sub-reservoirs, one-way stopcock 50 must be opened. Air may then flow through pressure switch 46 and air filter 48 and into sub-reservoirs 60, 62. If valve/solenoid assemblies 52, 54 are open while the ink pressure is increased within sub-reservoirs 60, 62, air and ink may be forced back into the main ink reservoir. However, when pressure switch 46 senses increased pressure, it opens to prevent power from reaching valve/solenoid assemblies 52, 54. Thus, valve/solenoid assemblies 52, 54 are unable to open while pressure is increased and air and ink cannot flow back from sub-reservoirs 60, 62 and into the main reservoir while ink supply system 10 is being primed.

Once the system is primed, the pressure is relieved within sub-reservoirs 60, 62. The system is then at static pressure and ready for printing. However, during the priming process, the ink level may have decreased some in sub-reservoirs 60, 62. This will be detected by the level sensors therein. The level sensors will send a signal to controller 64. Controller 64 will signal valve/solenoid assemblies 52, 54 to open allowing ink to flow in via the main ink reservoir.

During printing, controller 64 sends printing signals to print head 86 via a print head communication line. Controller 64 receives printing signals via a controller communication line, which is attached to a central processing unit as described above, such as a PC or a PLC for example. Ink is supplied from each sub-reservoir 60, 62 to a corresponding inlet of print head 86 by capillary action through associated conduits during printing. Accordingly, the height difference between each sub-reservoir fluid level and each corresponding inlet of print head portion 86 should be such as to provide proper capillary action pressure to the print head used. For example, the distance from each sub-reservoir fluid level to the lowest orifice of the corresponding inlet of print head 86 that it feeds may be from about 1 inch to about 2 inches, such as 1.5 inches for example. As each sub-reservoir 60, 62 is drained during printing so that the sub-reservoir fluid height falls below the specified range, the corresponding valve/solenoid assembly 52, 54 is opened and the sub-reservoir 60, 62 is filled from the main reservoir until the sub-reservoir fluid height rises above the specified range, at which time the corresponding valve/solenoid assembly 52, 54 is closed, as described above. For example, the specified range may be about 3 mm so that the height of the top surface varies by about 3 mm during printing. However, the range could be smaller or larger than 3 mm. This filling process may continue for each sub-reservoir 60, 62 during printing "on the fly". Accordingly, each sub-reservoir fluid level in each c each sub-reservoir 60, 62 may be maintained substantially constant and, therefore, the static pressure at each inlet of print head 86 may be substantially the same for each print head portion.

Because each sub-reservoir 60, 62 is filled independently, each sub-reservoir 60, 62 may be filled appropriately, even though sub-reservoirs 60, 62 may be drained at different rates during printing. Moreover, because each sub-reservoir 60, 62 is filled independently, multiple ink sources can be used, such as ink sources with different colors. This would allow different colors to be used for different portions of print head 86. Moreover, the present invention will provide advantageous results if multiple print heads are used or if more or fewer sub-reservoirs are used. For example, the present invention would even provide advantageous results if it were used with a single sub-reservoir.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation. Similarly, any steps or sequence of steps of the method of the present invention indicated herein are given as examples of possible steps or sequence of steps and not as limitations.

The invention claimed is:

1. A closed ink supply system wherein air is sealed outside the system and not allowed to flow into components of the system, the system comprising:

(1) an ink source;

(2) a first ink sub-reservoir comprising:

(a) a first top fluid surface at a first sub-reservoir fluid height;

(b) a first sub-reservoir ink inlet fluidly connected to the ink source; and (c) a first sub-reservoir outlet and a second sub-reservoir outlet that is above the first sub-reservoir outlet;

(3) a print head comprising:

(a) a first print head portion fluidly connected to the first sub-reservoir outlet and having a first pressure at the first print head portion; and (b) a second print head portion fluidly connected to the second sub-reservoir outlet and having a second pressure at the second print head portion substantially equal to the first pressure, the second print head portion being above the first print head portion by a difference proportional to a difference between the second and first sub-reservoir outlets;

(c) wherein the first and second pressures are primarily caused by capillary forces.

2. The ink supply system of claim 1 further comprising:

(4) a valve system fluidly connected between the ink source and the first sub-reservoir ink inlet;

(5) an actuator system connected to the valve system; and (6) a first sensor connected to the actuator system, wherein the first sensor senses the first sub-reservoir fluid height, such that if the first sub-reservoir fluid height is below a first height range, the first sensor emits a signal to the actuator system, whereby the actuator system actuates the valve system, allowing ink to flow from the ink source to the first sub-reservoir ink inlet, and if the first sub-reservoir fluid height is above the first height range, the first sensor emits a signal to the actuator system, whereby the actuator system actuates the valve system, preventing ink from flowing from the ink source to the first sub-reservoir ink inlet.

3. The ink supply system of claim 2, wherein the actuator system comprises a first actuator connected to the first sensor, and wherein the valve system comprises a first valve connected to the first actuator.

4. The ink supply system of claim 1, wherein the ink source comprises a main reservoir, and wherein a fluid connection between the first sub-reservoir ink inlet and the ink source comprises a gravity-fed conduit extending from the ink source to the first sub-reservoir ink inlet.

5. The ink supply system of claim 1, wherein the first sub-reservoir ink inlet is located at an upper portion of the first sub-reservoir, and wherein the first sub-reservoir outlet and the second sub-reservoir outlet are located at a lower portion of the first sub-reservoir.

6. The ink supply system of claim 1 further comprising:

(4) a pressure source; and wherein the first ink sub-reservoir further comprises:

(d) a first sub-reservoir pressure inlet fluidly connected to the pressure source.

7. The ink supply system of claim 1 further comprising:

(4) a second ink sub-reservoir comprising:

(a) a second top fluid surface at a second sub-reservoir fluid height that is above the first sub-reservoir fluid height;

(b) a second sub-reservoir ink inlet fluidly connected to the ink source; and (c) a third sub-reservoir outlet and a fourth sub-reservoir outlet that is above the third sub-reservoir outlet; and wherein the print head further comprises:

(c) a third print head portion fluidly connected to the third sub-reservoir outlet; and (d) a fourth print head portion fluidly connected to the fourth sub-reservoir outlet, the fourth print head portion being above the third print head portion and the third print head portion being above the second print head portion, whereby a third pressure at the third print head portion and a fourth pressure at the fourth print head portion are substantially equal to the first pressure at the first print head portion and the second pressure at the second print head portion.

8. The ink supply system of claim 7 further comprising:

(5) a valve system fluidly connected between the ink source and the first sub-reservoir ink inlet and the second sub-reservoir ink inlet;

(6) an actuator system connected to the valve system;

(7) a first sensor connected to the actuator system, wherein the first sensor senses the first sub-reservoir fluid height, such that if the first sub-reservoir fluid height is below a first height range, the first sensor emits a signal to the actuator system, whereby the actuator system actuates the valve system, allowing ink to flow from the ink source to the first sub-reservoir ink inlet, and if the first sub-reservoir fluid height is above the first height range, the first sensor emits a signal to the actuator system, whereby the actuator system actuates the valve system, preventing ink from flowing from the ink source to the first sub-reservoir ink inlet; and (8) a second sensor connected to the actuator system, wherein the second sensor senses the second sub-reservoir fluid height, such that if the second sub-reservoir fluid height is below a second height range, the second sensor emits a signal to the actuator system, whereby the actuator system actuates the valve system, allowing ink to flow from the ink source to the second sub-reservoir ink inlet, and if the second sub-reservoir fluid height is above the second height range, the second sensor emits a signal to the actuator system, whereby the actuator system actuates the valve system, preventing ink from flowing from the ink source to the second sub-reservoir ink inlet.

9. The ink supply system of claim 8, wherein the actuator system comprises a first actuator connected to the first sensor and a second actuator connected to the second sensor, and wherein the valve system comprises a first valve connected to the first actuator and a second valve connected to the second actuator.

10. The ink supply system of claim 7, wherein the ink source comprises a main reservoir, and wherein fluid connections between the first sub-reservoir ink inlet and the ink source and the second sub-reservoir ink inlet and the ink source comprise gravity-fed conduits extending from the ink source to the first sub-reservoir ink inlet and the ink source to the second sub-reservoir ink inlet respectively.

11. The ink supply system of claim 7, wherein the first sub-reservoir ink inlet is located at an upper portion of the first sub-reservoir, wherein the first sub-reservoir outlet and the second sub-reservoir outlet are located at a lower portion of the first sub-reservoir; wherein the second sub-reservoir ink inlet is located at an upper portion of the second sub-reservoir, and wherein the third sub-reservoir outlet and the fourth sub-reservoir outlet are located at a lower portion of the second sub-reservoir.

12. The ink supply system of claim 7, wherein the first ink sub-reservoir and the second ink sub-reservoir are adjustable in height.

13. The ink supply system of claim 7 further comprising:

(4) a pressure source;

wherein the first ink sub-reservoir further comprises:

(d) a first sub-reservoir pressure inlet fluidly connected to the pressure source; and wherein the second ink sub-reservoir further comprises:

(d) a second sub-reservoir pressure inlet fluidly connected to the pressure source.

14. A method of supplying ink to a print head through a closed ink supply system wherein air is sealed outside the system and not allowed to flow into components of the system, the method comprising the steps of:

(1) supplying ink from a first ink sub-reservoir to a first print head portion fluidly connected to a first sub-reservoir outlet of the first ink sub-reservoir;

(2) supplying ink from the first ink sub-reservoir to a second print head portion above the first print head portion fluidly connected to a second sub-reservoir outlet above the first sub-reservoir outlet of the first ink sub-reservoir;

(3) causing a first pressure at the first print head portion to be substantially equal to a second pressure at the second print head portion by capillary forces;

(4) sensing a first sub-reservoir fluid height;

(5) supplying ink to the first ink sub-reservoir if the first sub-reservoir fluid height is below a first height range; and (6) ceasing supplying ink to the first ink sub-reservoir if the first sub-reservoir fluid height is above the first height range.

15. The method of claim 14, further comprising the steps of:

(6) supplying ink from a second ink sub-reservoir to a third print head portion above the second print head portion fluidly connected to a third sub-reservoir outlet of the second ink sub-reservoir;

(7) supplying ink from the second ink sub-reservoir to a fourth print head portion above the third print head portion fluidly connected to a fourth sub-reservoir outlet above the third sub-reservoir outlet of the second ink sub-reservoir;

(8) causing a third pressure at the third print head portion to be substantially equal to a fourth pressure at the fourth print head portion by capillary forces;

(9) sensing a second sub-reservoir fluid height above the first sub-reservoir fluid height;

(10) supplying ink to the second ink sub-reservoir if the second sub-reservoir fluid height is below a second height range; and

(11) ceasing supplying ink to the second ink sub-reservoir if the second sub-reservoir fluid height is above the second height range.

16. The method of claim 14, further comprising supplying ink to the first ink sub-reservoir by using gravity to feed ink through a conduit that extends from an ink source to the first ink sub-reservoir.

17. The method of claim 14, wherein the step of supplying ink to the first ink sub-reservoir comprises actuating a valve system, and wherein the step of ceasing supplying ink to the first ink sub-reservoir comprises actuating the valve system.

18. The method of claim 15 further comprising:

(12) causing the first and second pressures to be equal to the third and fourth pressures by adjusting a height of at least one of the first ink sub-reservoir and the second sub-reservoir relative to the other of the first sub-reservoir and the second sub-reservoir.

19. A closed ink supply system wherein air is sealed outside the system and not allowed to flow into components of the system, the system comprising:

(1) an ink source;

(2) a first ink sub-reservoir comprising:

(a) a first top fluid surface at a first sub-reservoir fluid height;

(b) a first sub-reservoir ink inlet fluidly connected to the ink source; and (c) a first sub-reservoir outlet and a second sub-reservoir outlet that is above the first sub-reservoir outlet;

(3) a height adjustment mechanism connected to the first sub-reservoir; and (4) a print head comprising:

(a) a first print head portion fluidly connected to the first sub-reservoir outlet and having a first pressure at the first print head portion; and (b) a second print head portion fluidly connected to the second sub-reservoir outlet and having a second pressure at the second print head portion;

(c) the second print head portion being above the first print head portion by a difference proportional to a difference between the second and first sub-reservoir outlets;

(c) wherein the first and second pressures are caused by gravity-fed pressure head, capillary forces, and the relative height to which the first sub-reservoir is adjusted.

* * * * *